US007478897B2

(12) United States Patent
Takagi

(10) Patent No.: US 7,478,897 B2
(45) Date of Patent: Jan. 20, 2009

(54) INK JET PRINTER AND METHOD OF WIPING AN INK DISCHARGING PLANE

(75) Inventor: Osamu Takagi, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 295 days.

(21) Appl. No.: 11/229,714

(22) Filed: Sep. 20, 2005

(65) Prior Publication Data

US 2006/0066663 A1 Mar. 30, 2006

(30) Foreign Application Priority Data

Sep. 27, 2004 (JP) ..... 2004-279194

(51) Int. Cl.
*B41J 2/015* (2006.01)
*B41J 2/165* (2006.01)

(52) U.S. Cl. ..... 347/33; 347/21; 347/22

(58) Field of Classification Search ..... 347/20–36, 347/84, 93, 95, 98, 100
See application file for complete search history.

(56) References Cited

U.S. PATENT DOCUMENTS 5,396,277 A * 3/1995 Gast et al. ..... 347/33
5,552,811 A 9/1996 Kurata et al.
6,158,839 A * 12/2000 Fukushima et al. ..... 347/33
6,497,472 B2 * 12/2002 Sharma et al. ..... 347/28
6,802,588 B2 * 10/2004 Garbacz et al. ..... 347/28
6,869,161 B2 * 3/2005 Wouters et al. ..... 347/28
2005/0035991 A1 * 2/2005 Fredrickson ..... 347/33

FOREIGN PATENT DOCUMENTS

JP 9-52373 2/1997
JP 2001-30514 2/2001
JP 2003-191480 7/2003

* cited by examiner

*Primary Examiner*—Julian D Huffman
*Assistant Examiner*—Jason S Uhlenhake
(74) *Attorney, Agent, or Firm*—Banner & Witcoff, Ltd.

(57) ABSTRACT

An ink jet printer is provided with an ink jet head, a wiper and a transferring device. The ink jet head has an ink discharging plane. A plurality of ink openings for discharging ink toward a print medium and a liquid opening for discharging liquid are formed on the ink discharging plane. The ink openings are closer to one end of the ink discharging plane than the liquid opening is. The liquid opening is closer to the other end of the ink discharging plane than the ink openings are. The wiper wipes the ink discharging plane of the ink jet head. The transferring device transfers the ink jet head and/or the wiper such that the wiper wipes the ink discharging plane from a beginning position located at the other end side of the ink discharging plane to a finishing position located at the one end side of the ink discharging plane. The liquid discharged from the liquid opening adheres to the wiper when the wiper wipes an area where the liquid opening is formed. A distance between the liquid opening and an ink opening located at the most upstream position of the wiping direction of the wiper is longer than a distance between the two adjacent ink openings.

15 Claims, 10 Drawing Sheets

INK JET PRINTER AND METHOD OF WIPING AN INK DISCHARGING PLANE

CROSS-REFERENCE TO RELATED APPLICATION

This application claims priority to Japanese Patent Application No. 2004-279194, filed on Sep. 27, 2004, the contents of which are hereby incorporated by reference into the present application.

BACKGROUND OF THE INVENTION

1. Field of the Invention

The present invention relates to an ink jet printer. The present invention also relates to a method of wiping an ink discharging plane.

2. Description of the Related Art

Ink jet printers are well known. An ink jet printer has an ink jet head. The ink jet head has an ink discharging plane. A plurality of ink openings is formed on the ink discharging plane. Ink is discharged from these ink openings toward a print medium. In this way, text and graphics will be printed on the print medium.

When ink is discharged from the ink openings for printing, the ink may adhere to the ink discharging plane. In addition, the ink may adhere to the ink discharging plane when processes which recover the ink discharging ability of the ink jet head, such as a purging process, a flushing process, or the like are performed. Viscosity of the ink adhered to the ink discharging plane will increase over time. This high viscosity ink sometimes closes the ink openings. When closed ink openings are present, ideal printing results cannot be obtained. Because of this, a wiper that will wipe off the ink adhered to the ink discharging plane is sometimes used. An operation of the wiper wiping the ink discharging plane will be hereinafter referred to as a "wiping operation".

Japanese Patent Application Publication No. 9-52373 discloses an ink jet printer having a wiper. This ink jet printer adopts a carrier jet type. That is, a plurality of ink openings for discharging ink toward a print medium and a plurality of liquid openings for discharging dilution liquid are formed on an ink discharging plane of an ink jet head. One liquid opening is located adjacent to one ink opening. The dilution liquid discharged from each liquid opening dilutes the ink discharged from each ink opening. Ink diluted with the dilution liquid adheres to the print medium. This ink jet printer can change density of ink adhering to the print medium by adjusting an amount of the discharged dilution liquid. In this ink jet printer, the ink openings are formed on one end side of the ink discharging plane, and the liquid openings are formed on the other end side of the ink discharging plane. While the wiper is in contact with the ink discharging plane, it will move from the other end side to the one end side along the ink discharging plane. In this way, the wiping operation is performed. The dilution liquid may be discharged from the liquid openings when the wiper faces the liquid openings during the wiping operation.

In the ink jet printer of this conventional technology, a distance between the liquid opening and the ink opening located adjacent to the liquid opening is extremely small because it is required that the dilution liquid discharged from the liquid opening is mixed with the ink discharged from the ink opening. This distance is smaller than the distance between two adjacent ink openings.

When a wiping operation is performed by means of a wiper, ink that has been wiped off from the ink discharging plane will adhere to the wiper. Viscosity of the ink adhered to the wiper will increase over time. When a next wiping operation is performed by the wiper with the high viscosity ink, the ink on the wiper may be pushed into the ink openings. In this situation, ideal printing results cannot be obtained because the ink openings will be closed by the ink.

In the aforementioned conventional technology, the dilution liquid may adhere to the wiper during the wiping operation. The dilution liquid may dilute the ink adhered on the wiper. It seems that the ink on the wiper isn't pushed into the ink openings because the ink on the wiper is diluted with the dilution liquid. However, research by the present inventor has made it clear that even if low viscosity liquid is supplied to high viscosity ink adhered to the wiper, the ink on the wiper cannot be diluted to viscosity that is so low that the ink openings will not be closed. Even if the high viscosity ink adhered to the wiper is diluted, ink having medium viscosity will remain on the wiper. The present inventor discovered that, in the ink jet printer of the aforementioned conventional technology, the ink openings will become closed by the medium viscosity ink remaining on the wiper.

BRIEF SUMMARY OF THE INVENTION

The present specification provides an ink jet printer that can effectively prevent the phenomenon in which ink openings become closed by ink adhered to a wiper.

The ink jet printer disclosed by means of the present specification comprises an inkjet head, a wiper, and a transferring device. The inkjet head has an ink discharging plane. A plurality of ink openings for discharging ink toward a print medium and a liquid opening for discharging liquid are formed on the ink discharging plane. The ink openings are closer to one end of the ink discharging plane than the liquid opening is, and the liquid opening is closer to the other end of the ink discharging plane than the ink openings are. The wiper wipes the ink discharging plane of the ink jet head. The transferring device transfers the ink jet head and/or the wiper. By transferring the ink jet head and/or the wiper, the wiper will wipe the ink discharging plane from a beginning position located on the other end side of the ink discharging plane to a finishing position located on the one end side of the ink discharging plane. The liquid discharged from the liquid opening adheres to the wiper when the wiper wipes an area where the liquid opening is formed. With this ink jet printer, ink adhered to the wiper will be diluted by the liquid. In this technology, the liquid is supplied from the liquid opening formed on the ink discharging plane. Supplying the liquid to the wiper can be performed by easier structure than in a situation in which a device that supplies the liquid is formed separately from the ink jet head.

In the case where the liquid adheres to the wiper, high viscosity ink adhered to the wiper can be diluted to medium viscosity. The present inventor discovered that, after the high viscosity ink on the wiper was diluted, the ink will be removed from the wiper when the wiper is transferred as it is being pushed against the ink discharging plane. In other words, the medium viscosity ink adhered to the wiper will be removed from the wiper by rubbing against the ink discharging plane.

The present inventor discovered that, in the case where a distance that the wiper with the medium viscosity ink rubs against the ink discharging plane is longer than a distance between two adjacent ink openings, the ink will be effectively removed from the wiper. In this ink jet printer, the distance between the liquid opening and the ink opening located at the most upstream position of the wiping direction of the wiper is set so as to be longer than the distance between two adjacent ink openings. In this situation, the distance that the wiper with the medium viscosity ink rubs against the ink discharging plane before the wiper wipes an area where the ink openings are formed will be longer than the distance between two adjacent ink openings. Therefore, the ink adhered to the wiper is effectively removed before the wiper wipes the area where the ink openings are formed. In this ink jet printer, the phenomenon in which the ink openings become closed by ink adhered to the wiper can be effectively prevented.

BRIEF DESCRIPTION OF THE DRAWINGS

FIG. 1 shows a diagrammatic view of the ink jet printer.

FIG. 5(*a*) shows the wiper in contact with the ink discharging plane. FIG. 5(*b*) shows the wiper not in contact with the ink discharging plane.

FIG. 8(*a*) shows an ink catching sheet moving to a position that faces the ink discharging plane. FIG. 8(*b*) shows the ink catching sheet facing the ink discharge plane. FIG. 8(*c*) shows the ink discharging plane being wiped by means of the wiper.

DETAILED DESCRIPTION OF THE INVENTION

First Embodiment

Figure 1:
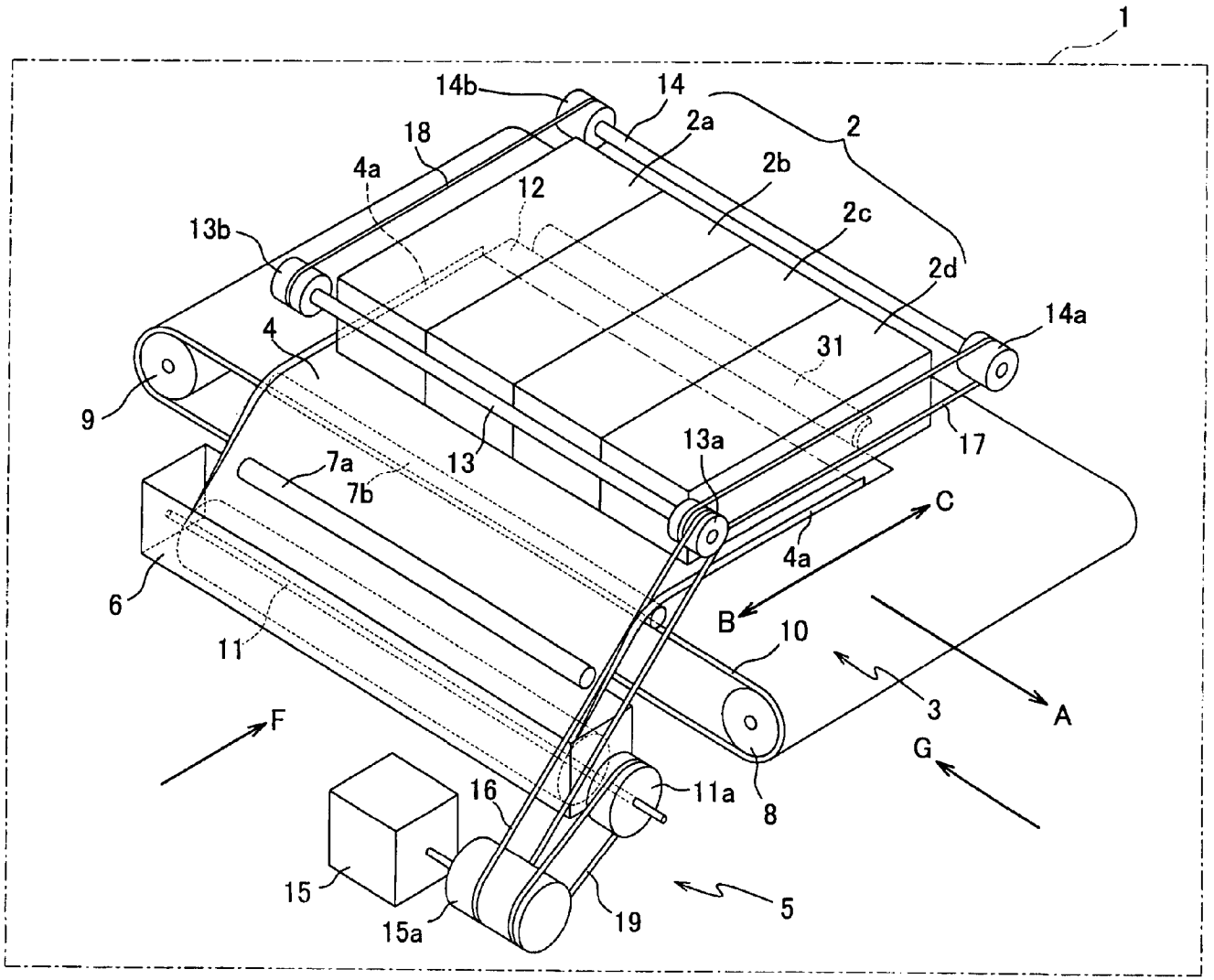
FIG. 1 shows an oblique view of an ink jet printer of a first embodiment.

An ink jet printer 1 of a first embodiment will be described with reference to the figures. The ink jet printer 1 will be hereinafter referred to simply as "printer 1". FIG. 1 shows an outline of the printer 1.

The printer 1 has a line type ink jet head 2. The ink jet head 2 discharges ink toward a print medium (e.g., paper for printing). The printer 1 of the present embodiment has four ink jet heads 2*a*, 2*b*, 2*c*, 2*d*. Each ink jet head 2*a* to 2*d* is fixed to a printer main body (not shown in the figures). The printer 1 of the present embodiment is a line type ink jet printer.

The ink jet head 2*a* discharges cyan ink. The ink jet head 2*b* discharges magenta ink. The ink jet head 2*c* discharges yellow ink. The ink jet head 2*d* discharges black ink. Each ink jet head 2*a* to 2*d* is connected to an ink cartridge (not shown in the figures) of ink that respectively corresponds thereto. When ink is discharged from the ink jet heads 2*a* to 2*d*, the amount of ink discharged will be supplied to the ink jet heads 2*a* to 2*d* from the ink cartridges.

Figure 2:
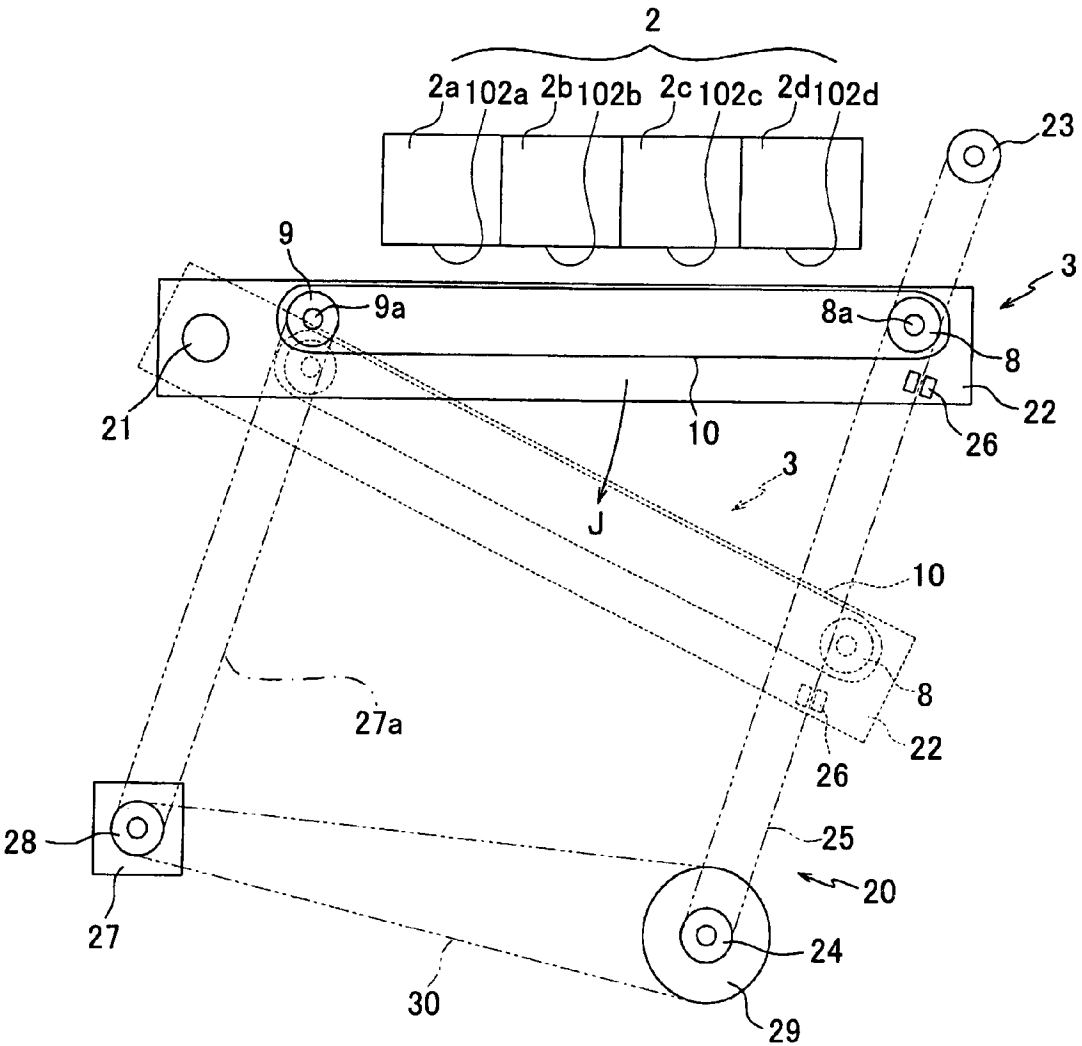
FIG. 2 is a lateral view of the ink jet printer when viewed from the direction of the arrow F in FIG. 1.
Figure 3:
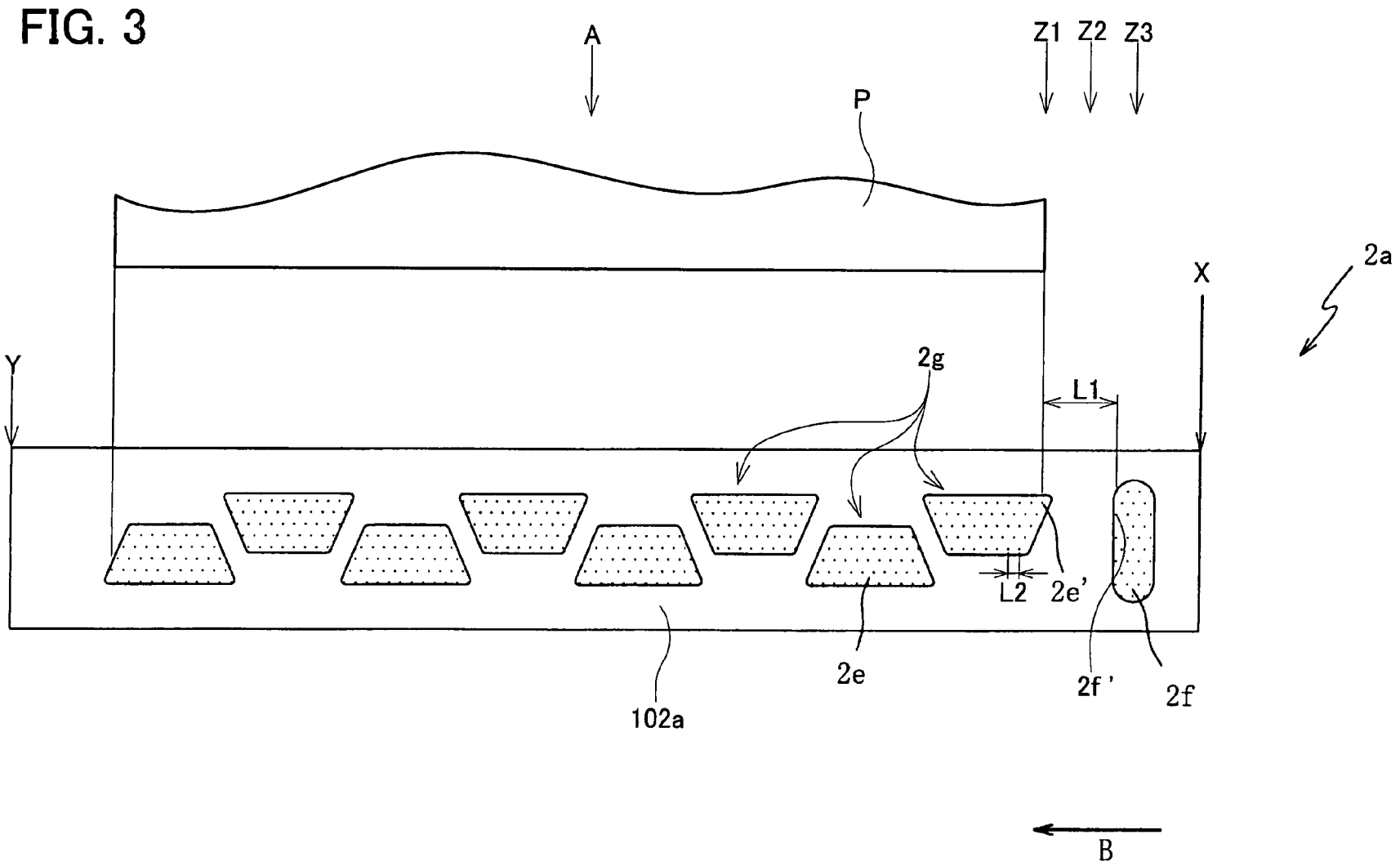
FIG. 3 shows a plan view of an ink discharging plane of an ink jet head.

Ink discharging planes 102*a* to 120*d* are formed on the respective bottom surfaces of the ink jet heads 2*a* to 2*d*. In FIG. 1, reference numerals are not attached to the ink discharging planes 102*a* to 102*d*. The ink discharging planes 102*a* to 102*d* are shown in FIG. 2. In addition, FIG. 3 shows a plan view of the ink discharging plane 102*a*. As shown in FIG. 3, the ink discharging plane 102*a* has a rectangular shape in the plan view. A large number of ink openings 2*e* are formed on the ink discharging plane 102*a*. In FIG. 3, reference numerals are not attached to all of the ink openings 2*e*. An ink opening group 2*g* is formed by arranging the plurality of ink openings 2*e* in a trapezoid shape. In the present embodiment, eight ink opening groups 2*g* are formed. The eight trapezoid shaped ink opening groups 2*g* are aligned along a longitudinal direction of the ink discharging plane 102*a*. Two adjacent ink opening groups 2*g* are inverted in the vertical direction of FIG. 3 with respect to each other. In other words, the long side of the trapezoid shape of one ink opening group 2*g* is located on the upper side, and the long side of the trapezoid shape of the other ink opening group 2*g* adjacent thereto is located on the lower side. Two adjacent ink opening groups 2*g* are located so as to overlap in the vertical direction. In addition, two adjacent ink opening groups 2*g* are located so as to overlap in the horizontal direction. One actuator unit (not shown in the figures) is arranged to correspond to one ink opening group 2*g*. Ink is discharged from ink openings 2*e* of each corresponding ink opening group 2*g* by means of each actuator units.

A plurality of liquid openings 2*f* is formed on the ink discharging plane 102*a*. In FIG. 3, reference numerals are not attached to all of the liquid openings 2*f*. The plurality of liquid openings 2*f* is aligned in an oval shape. The liquid openings 2*f* are extending in the vertical direction of the FIG. 3. The liquid openings 2*f* are located on the right side of the eight ink opening groups 2*g* in the FIG. 3. A cleaning liquid is discharged from each liquid opening 2*f*. A special actuator unit (not shown in the figures) that causes the cleaning liquid to be discharged from the liquid openings 2*f* is arranged on the printer 1. Each of the liquid openings 2*f* is connected to a cleaning liquid cartridge (not shown in the figures) that stores the cleaning liquid. The special actuator unit causes cleaning liquid to be discharged from each liquid opening 2*f* by applying pressure to the cleaning liquid inside the ink jet head 2*a*. A low viscosity liquid is adopted as the cleaning liquid. The cleaning liquid of the present embodiment is liquid made by removing coloring from ink. The cleaning liquid is mixture of water and aqueous organic solvent (e.g., glycerin). The details of how the cleaning liquid discharged from the liquid openings 2*f* is used will be described below.

The ink openings 2*e* are located on the left end side of the ink discharging plane 102*a* (the arrow B side of FIG. 1). The liquid openings 2*f* are located on the right end side of the ink discharging plane 102*a* (the arrow C side of FIG. 1). A predetermined distance L1 is arranged between the ink opening 2*e*' located on the furthest right side and the liquid opening 2*f* located on the furthest left side. This distance L1 of the present embodiment is set to approximately 1 inch. The distance L1 is longer than the distance L2 between two adjacent ink openings 2*e*. The distance L2 between two adjacent ink openings 2*e* is set to approximately 0.027 inch in the horizontal direction of the FIG. 3. This distance L2 is a distance between a center of one ink opening 2*e* and a center of adjacent ink opening 2*e*.

The reference symbol P in FIG. 3 is a print medium. The print medium P is transferred in the direction of the arrow A. The direction of the arrow A in FIG. 3 matches the direction of the arrow A in FIG. 1. The print medium P in FIG. 3 is the largest size that the printer 1 of the present embodiment can print. When the print medium A is transferred in the direction of the arrow A, the print medium P will face the ink openings 2*e*. However, the print medium P will not face the liquid openings 2*f*.

The other ink jet heads 102*b* to 102*d* have a structure that is identical to the inkjet head 102*a*. In other words, the plurality of ink openings 2*e* and the plurality of liquid openings 2*f* are respectively formed on the ink discharging planes 102*b* to 102*d* of each ink jet head 2*b* to 2*d*.

Figure 6:
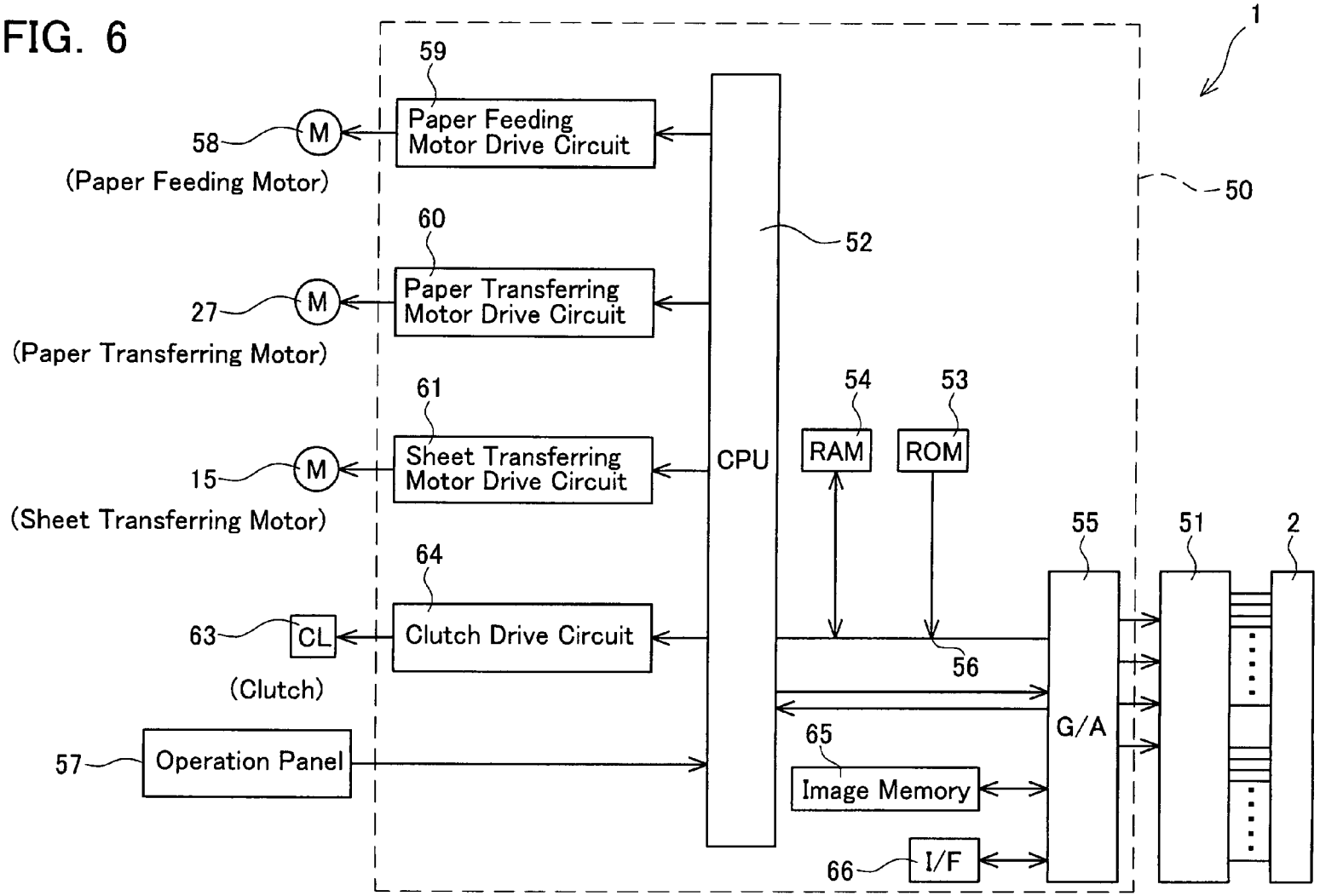
FIG. 6 shows a schematic view of an electric circuit formation of the ink jet printer.

As shown in FIG. 1, a device 3 that transfers print media (e.g., paper for printing) is located below the ink jet heads 2*a* to 2*d*. The paper transferring device 3 comprises a pair of belt rollers 8, 9, a transferring belt 10 that is suspended between the belt rollers 8, 9, and a paper transferring motor 27 that drives the belt rollers 8, 9 (this motor 27 is shown in FIGS. 2 and 6).

When the paper transferring motor 27 drives the belt rollers 8, 9, the belt rollers 8, 9 will rotate. When the belt rollers 8, 9 rotate, the transferring belt 10 also rotates. By rotating the transferring belt 10, the print medium mounted on the upper surface of the transferring belt 10 will be transferred in the direction of the arrow A. The print medium will be conveyed between the transferring belt 10 and the ink jet heads 2*a* to 2*d*. At this stage, ink will be discharged in a pattern based on print data from the ink jet heads 2*a* to 2*d*. In this way, text or graphics will be formed on the print medium. Print media printed by the ink jet heads 2*a* to 2*d* will be discharged to the outside of the printer 1 by means of a paper discharge mechanism not shown in the figures. In addition, a paper feeding mechanism (not shown in the figures) that feeds print media to the paper transferring device 3 is located below the paper transferring device 3. Also, a cap (not shown in the figures) that covers the ink discharging planes 102*a* to 102*d* when printing is not performed is located below the paper transferring device 3.

The paper transferring device 3 can move in a direction away from the ink jet heads 2*a* to 2*d*. The mechanism 20 that moves the paper transferring device 3 will be described with reference to FIG. 2. FIG. 2 is a lateral view of the printer 1 when viewed from the direction of the arrow F in FIG. 1. Although omitted from FIG. 1, the paper transferring device 3 has a main frame 22. The main frame 22 supports the shafts 8*a*, 9*a* of the belt rollers 8, 9 in a manner allowing its rotation. The moving mechanism 20 moves the paper transferring device 3 by moving the main frame 22.

The moving mechanism 20 comprises a reference shaft 21, a pair of movement pulleys 23, 24, a movement belt 25, a linking member 26, a clutch 63 (see FIG. 6), a pair of transmission pulleys 28, 29, a transmission belt 30, and the like. The reference shaft 21 is supported by a chassis (not shown in the figures) in a manner allowing its rotation. The reference shaft 21 is fixed to the main frame 22. The movement pulleys 23, 24 are rotatably but non-movably supported by the chassis. The movement pulley 23 is located above the main frame 22. The movement pulley 24 is located below the main frame 23. The movement belt 25 is suspended between the movement pulleys 23, 24. The linking member 26 links the right end portion of the main frame 22 with the movement belt 25. The transmission belt 30 is suspended between the one transmission pulley 28 and the other transmission pulley 29. The other transmission pulley 29 is coaxial with the movement pulley 24, and rotates unitarily with the movement pulley 24. The one transmission pulley 28 is connected to the paper transferring motor 27 via the clutch 63 described below.

The clutch 63 is used as follows. As noted above, the paper transferring motor 27 of the paper transferring device 3 drives the belt rollers 8, 9. A belt 27*a* is suspended between the transmission pulley 28 and the belt roller 9. The belt 27*a* transmits the rotational force of the paper transferring motor 27. In this way, the belt roller 9 will rotate. The paper transferring motor 27 of the present embodiment is also used as a motor that rotates the one transmission pulley 28. In other words, the paper transferring motor 27 will be used as the motor that rotates the belt roller 9 and the motor that rotates the transmission pulley 28. The clutch 63 switches whether the rotational force of the paper transferring motor 27 is transmitted to the belt roller 9 or to the transmission pulley 28.

The one transmission pulley 28 is linked to the drive shaft of the paper transferring motor 27 by operation of the clutch 63. The other transmission pulley 29 is located on the right side of the one transmission pulley 28. The other transmission pulley 29 is located below the main frame 22. The transmission belt 30 is suspended between the transmission pulleys 28, 29.

The rotational force of the printing paper transferring motor 27 is transmitted to the other transmission pulley 29 via the one transmission pulley 28 and the transmission belt 30. When the transmission pulley 29 rotates, the movement belt 25 will rotate. When the movement belt 25 rotates, force will be applied to the main frame 22 via the linking member 26. In this way, the main frame 22 will pivot around the reference shaft 21. For example, when the transmission pulley 29 rotates clockwise in FIG. 2, the main frame 22 will also pivot clockwise (arrow J). In this way, the main frame 22 (the paper transferring device 3) will move away from the ink jet head 2. In FIG. 2, the main frame 22 is shown moving away from the ink jet head 2 with the broken lines. In contrast, when the transmission pulley 29 rotates counterclockwise, the main frame 22 will pivot counterclockwise. In this way, the main frame 22 shown with the broken lines will return to a position facing the ink jet head 2 (the position shown with the solid lines).

The printer 1 of the present embodiment will perform a purge process before performing a next print operation in situations in which the printer 1 has not performed a print operation for a long period of time. In the purge process, ink is forcibly discharged from each of the ink openings 2*e* by supplying pressurized ink to the ink jet head 2. In situations in which a print operation has not been performed for a long period of time, the viscosity of the ink inside the ink openings 2*e* will be high. In the case where high viscosity ink is present in the ink openings 2*e*, ideal print results cannot be obtained. In the present embodiment, high viscosity ink inside the ink openings 2*e* will be removed by performing the purge process.

As shown in FIG. 1, an ink catching sheet 4 is prepared in order to catch the ink discharged from the ink jet head 2 by means of the aforementioned purge process. The ink catching sheet 4 is a thin sheet member that is flexible, ductile, and durable. The ink catching sheet 4 is located below the ink jet head 2 when the purge process is to be performed. The ink catching sheet 4 has a size that can cover all of the ink discharging planes 102*a* to 102*d*. Both edges 4*a*, 4*b* of the ink catching sheet 4 are curved upward. Both edges 4*a*, 4*b* function as levees. Both edges 4*a*, 4*b* prevent ink that has been caught by the ink catching sheet 4 from dropping on the transferring belt 10.

The printer 1 has a sheet transferring mechanism 5 that transfers the ink catching sheet 4, a storage box 6 that stores the ink catching sheet 4, and rollers 7*a*, 7*b*.

The sheet transferring mechanism 5 will pull the ink catching sheet 4 stored in the storage box 6 between the ink jet head 2 and the paper transferring device 3 when the purge process is to be performed. In addition, the ink catching sheet 4 is stored in the storage box 6 when the purge process is completed. The storage box 6 can store the ink catching sheet 4 in a rolled state. The roller 7*a* is supported by the printer main body in a manner allowing its rotation. The roller 7*a* is in contact with the upper surface of the ink catching sheet 4. The roller 7*a* will remove ink caught by the ink catching sheet 4 from the ink catching sheet 4. The roller 7*b* is supported by the printer main body in a manner allowing its rotation. The roller 7*b* is in contact with the lower surface of the ink catching sheet 4. The roller 7*b* retains the ink catching sheet 4.

Next, the construction of the sheet transferring mechanism 5 will be described in detail. The sheet transferring mechanism 5 has a sheet transferring motor 15. A pulley 15*a* is connected to the sheet transferring motor 15. Two belts 16, 19 are suspended on the pulley 15*a*. One belt 16 is suspended on a pulley 13*a*. A belt 17 is suspended on the pulley 13*a*. The pulley 13*a* is connected to one end of the shaft 13. The shaft 13 extends on the front side of FIG. 1 of the ink jet head 2 in the direction of the arrow A. A pulley 13*b* is connected to the other end of the shaft 13.

The belt 17 suspended on the pulley 13*a* is also suspended on a pulley 14*a*. The pulley 14*a* is connected to one end of a shaft 14. The shaft 14 extends on the rear side of FIG. 1 of the ink jet head 2 in the direction of the arrow A. A pulley 14*b* is connected to the other end of the shaft 14. A belt 18 is suspended between the pulley 13*b* and the pulley 14*b*.

The other belt 19 suspended on the pulley 15*a* is suspended on a pulley 11*a*. The pulley 11*a* is connected to one end of a roll shaft 11. The roll shaft 11 extends in the interior of the storage box 6 in the direction of the arrow A. The roll shaft 11 is supported on the storage box 6 in a manner allowing its rotation. The roll shaft 11 is connected to the ink catching sheet 4. The ink catching sheet 4 is rolled onto the roll shaft 11.

The sheet transferring mechanism 5 has a moving member 12 that extends in the direction of arrow A. The end of the moving member 12 in the direction of arrow A is connected to an upper side of the belt 17 by means of a member not shown in the figures. In addition, the end of the moving member 12 in the direction of arrow G (the direction opposite the arrow A) is connected to an upper side of the belt 18 by means of a member not shown in the figures. The construction of the moving member 12 will be described in detail with reference to FIGS. 4 and 5(*a*), (*b*).

Figure 4:
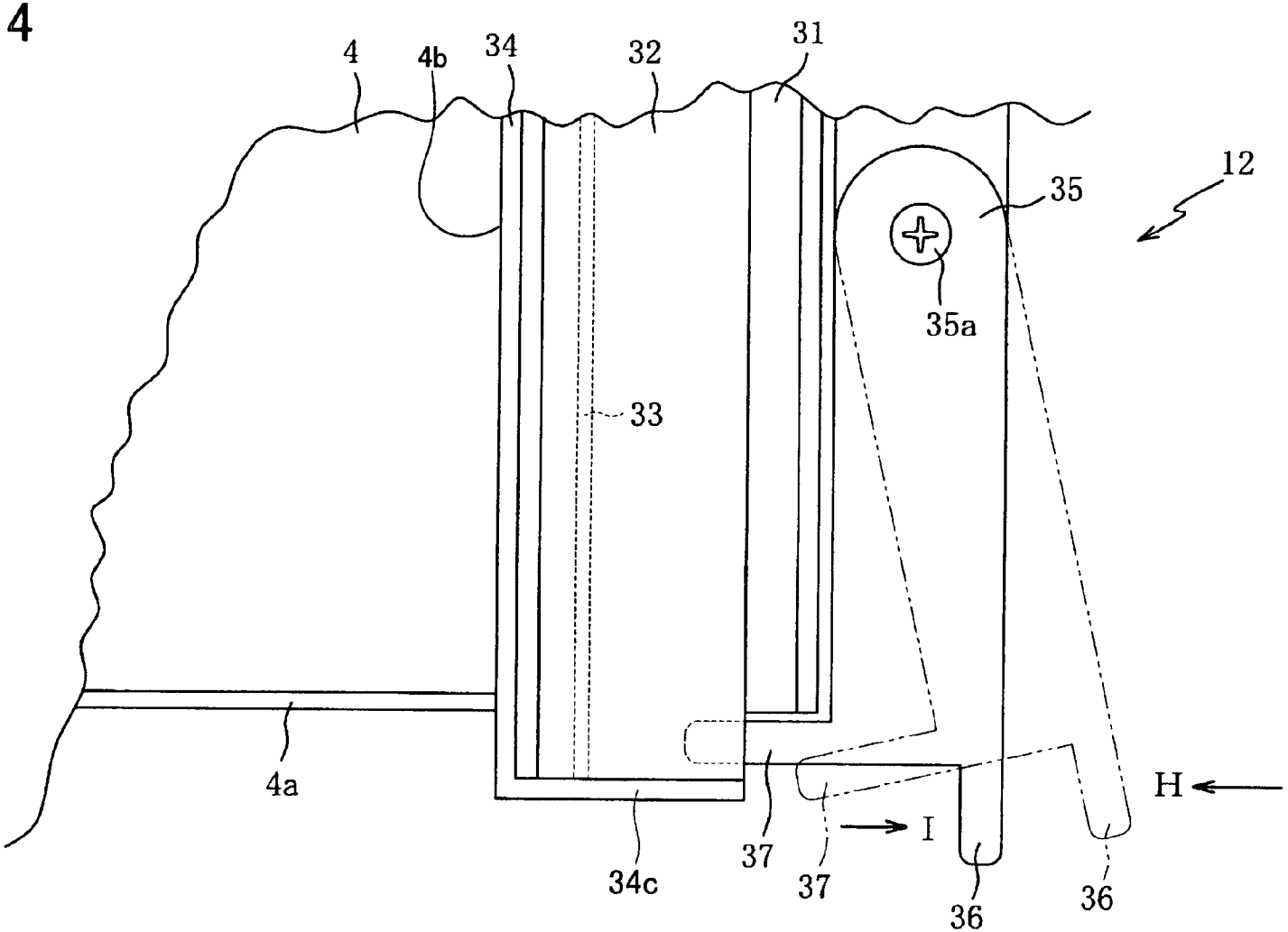
FIG. 4 shows a plan view of a portion of a moving member.
Figure 5:
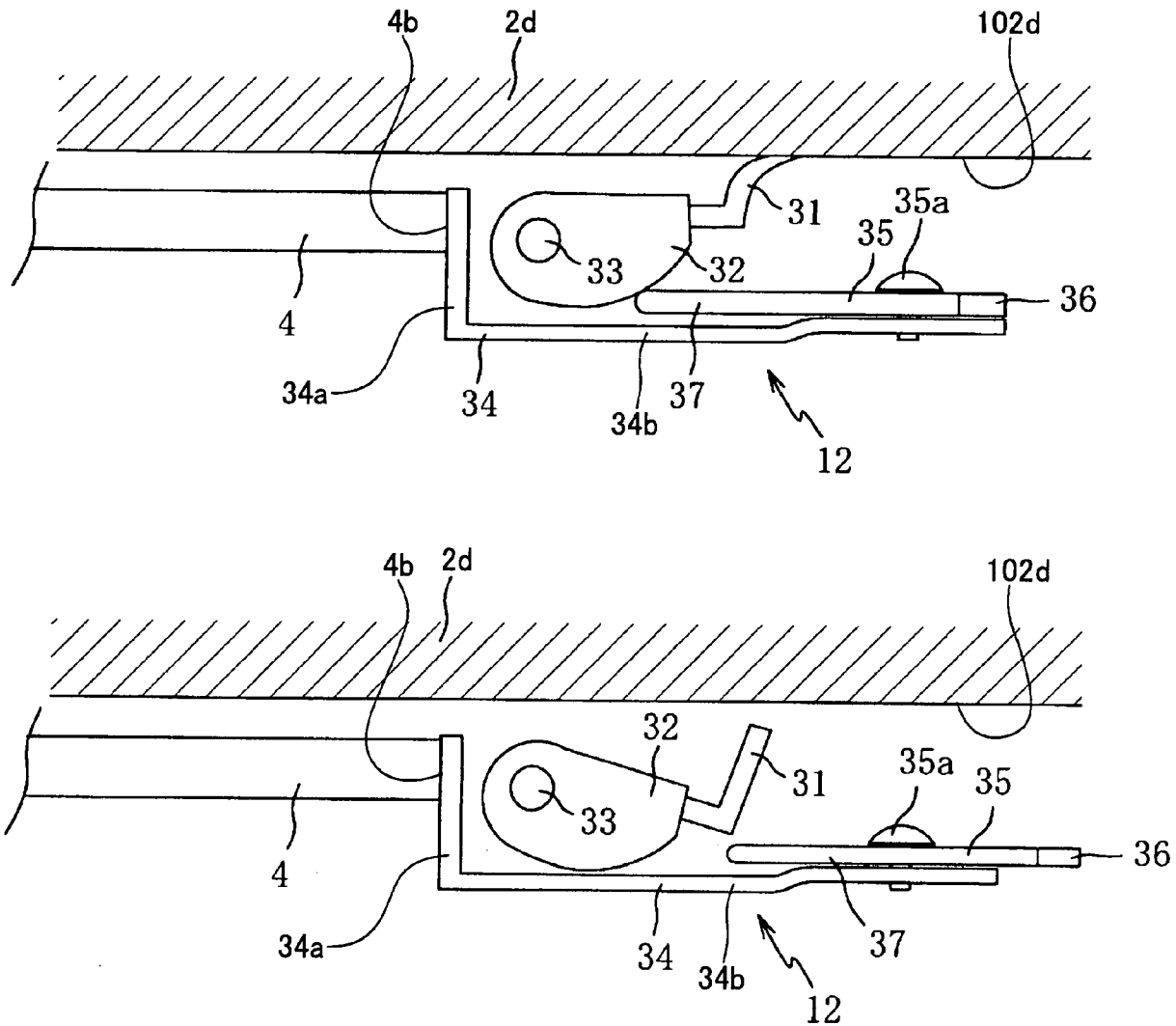
FIGS. 5(*a*) and (*b*) show side views of a wiper and members around the periphery thereof.

FIG. 4 shows a plan view of a portion of the moving member 12. FIGS. 5(*a*), (*b*) are lateral views of the moving member 12. Moving member 12 has a support member 34 that extends in the direction of arrow A of FIG. 1 (the vertical direction of FIG. 4). As shown in FIG. 5(*a*), the support member 34 has a first portion 34*a* that extends in the vertical direction of FIG. 5, and a second portion 34*b* that extends to the right from the lower end of the first portion 34*a*. The first portion 34*a* of the support member 34 is connected to the edge 4*b* of the ink catching sheet 4. As shown in FIG. 4, the support member 34 has side walls 34*c* on the lower and upper sides of FIG. 4. The side walls 34*c* are not shown in FIG. 5. The side walls 34*c* support a shaft 33 described below in a manner allowing its rotation. A wiper operation plate 35 is pivotably attached to the second portion 34*b* of the support member 34. The wiper operation plate 35 can pivot between the position shown with the solid lines and the position shown with the broken lines in FIG. 4. In FIG. 5(*a*), the wiper operation plate 35 is in the position shown with the solid lines in FIG. 4. In FIG. 5(*b*), the wiper operation plate 35 is in the position shown with the broken lines in FIG. 4. The wiper operation plate 35 is attached to the support member 34 by means of a member 35*a*. As clearly shown in FIG. 4, the wiper operation plate 35 has a first projection 36 that projects downward and a second projection 37 that projects to the left.

The shaft 33 is supported by the support member 34 in a manner allowing its rotation. The shaft 33 passes through the interior of a wiper holder 32. The shaft 33 is fixed to the wiper holder 32. The wiper holder 32 extends in a direction that is perpendicular to the plane of FIG. 5 (the direction of arrow A in FIG. 1). A wiper 31 is fixed to the right end of the wiper holder 32. The wiper 31 extends in a direction that is perpendicular to the plane of FIG. 5 (the direction of arrow A in FIG. 1). The wiper 31 straddles the entire area of the ink discharging planes 102*a* to 102*d* of the four ink jet heads 2*a* to 2*d*. The wiper 31 is formed by means of a flexible resin.

The sheet transferring mechanism 5 having the aforementioned construction is used as follows. The rotational force of the sheet transferring motor 15 shown in FIG. 1 is transmitted to the roll shaft 11 via the pulley 15*a*, the belt 19, and the pulley 11*a*. In this way, the roll shaft 11 will rotate. In addition, the rotational force of the sheet transferring motor 15 is also transmitted to the pulley 13*a* via the pulley 15*a* and the belt 16. The rotational force transmitted to the pulley 13*a* will rotate the shaft 13. In addition, the rotational force transmitted to the pulley 13*a* is transmitted to the pulley 14*a* via the belt 17. When the pulley 14*a* rotates, the shaft 14 will also rotate. The shaft 13 and the shaft 14 will rotate at the same speed and with the same timing. When the shafts 13, 14 rotate, the pulleys 13*b*, 14*b* and the belt 18 will also simultaneously rotate.

Note that a clutch may be provided that switches whether the rotational force of the pulley 15*a* is transmitted to the belt 16 or to the belt 19.

The support member 34 (see FIGS. 4 and 5) is fixed to the belts 17, 18. Because of this, when the belts 17, 18 rotate, the support member 34 will move in the direction of the arrow B or the arrow C in FIG. 1. In this way, the ink catching sheet 4 and the wiper 31 connected to the support member 34 will be transferred in the direction of the arrow B or the arrow C. When the support member 34 moves in the direction of arrow C, the ink catching sheet 4 will be pulled out from the storage box 6. At this point, the ink catching sheet 4 can be smoothly pulled out because the roll shaft 11 will also simultaneously rotate. When the support member 34 moves in the direction of arrow C, the ink discharging plane 102*a* to 102*d* (see FIG. 2) will be covered by means of the ink catching sheet 4.

A first striking member (not shown in the figures) that strikes the first projection 36 of the wiper operation plate 35 is provided on the printer main body (not shown in the figures). When the support member 34 moves the direction of arrow C, and the ink catching sheet 4 has covered the entire area of the ink discharging planes 102(*a*) to 102(*d*), the first projection 36 of the wiper operation plate 35 is pushed in the direction of the arrow H in FIG. 4 by means of the first striking member. In this way, the wiper operation plate 35 in the broken line position of FIG. 4 will pivot to the solid line position. When the wiper operation plate 35 pivots in the direction of the arrow H, it will pivot from the state shown in FIG. 5(*b*) to the state shown in FIG. 5(*a*). In other words, the second projection 37 of the wiper operation plate 35 will get into the underneath of the wiper holder 32. Then the wiper holder 32 pivots in the counterclockwise direction around the shaft 33. When the wiper holder 32 pivots in the counterclockwise direction in a state that the wiper faces the ink discharging planes 102*a* to 102*d*, the wiper 31 will make contact with the ink discharging planes 102*a* to 102*d*. The wiper 31 is bending when making contact with the ink discharging planes 102*a* to 102*d*. The wiper 31 will be firmly pushed against the ink discharging planes 102*a* to 102*d*. This state is clearly shown in FIG. 5(*a*).

The purge process will be performed in a state in which the ink catching sheet 4 has covered the entire area of the ink discharging planes 102*a* to 102*d*. The ink catching sheet 4 will catch ink discharged from the ink jet head 2.

When the purge process is complete, the sheet transferring motor 15 will drive (see FIG. 1), and the support member 34 will move in the direction of arrow B. The state shown in FIG. 5(*a*) will be maintained during this movement. In other words, the support member 34 will move in the direction of arrow B with the wiper 31 in contact with the ink discharging planes 102*a* to 102*d*. The ink discharging planes 102*a* to 102*d* will be wiped by the wiper 31. A second striking member (not shown in the figures) that strikes the first projection 36 of the wiper operation plate 35 is provided on the printer main body. When the entire area of the ink discharging planes 102*a* to 102*d* is wiped by the wiper 31, the first projection 36 of the wiper operation plate 35 will be pushed in the direction of the arrow I in FIG. 4 by means of the second striking member. In this way, the wiper operation plate 35 in the solid line position of FIG. 4 will pivot to the broken line position. When the wiper operation plate 35 pivots in the direction of the arrow I, it will pivot from the state shown in FIG. 5(*a*) to the state shown in FIG. 5(*b*). In other words, the state in which the second projection 37 of the wiper operation plate 35 has gotten into the underneath of the wiper holder 32 will be released. Then the wiper holder 32 pivots in the clockwise direction around the shaft 33. When the wiper holder 32 pivots in the clockwise direction, the wiper 31 will move away from the ink discharging planes 102*a* to 102*d*.

Next, the electrical configuration of the printer 1 will be described with reference to FIG. 6. FIG. 6 is a block diagram showing an outline of the electrical configuration.

As shown in FIG. 6, the printer 1 has a main control board 50 and a sub-control board 51. The main control board 50 performs overall control of the operation of the printer 1. The sub-control board 51 controls the operation of the ink jet head 2.

A CPU 52, a ROM 53, a RAM 54, a gate array (G/A) 55, an image memory 65, an interface (I/F) 66, and the like are mounted on the main control board 50. The CPU 52 is a one chip type microcomputer. The ROM 53 stores various control programs and the like that are performed by the CPU 52. For example, the ROM 53 stores a program related to the purge process. The RAM 54 temporarily stores various data and the like. The gate array 55 inputs various signals output from the CPU 52. For example, print timing signals and reset signals produced by the CPU 52 will be input. The CPU 52, ROM 53, RAM 54, and the gate array 55 are connected via a bus line 56. Image data transmitted from an external device such as a computer or the like is stored in the image memory 65. The interface (I/F) 66 is connected to the external device.

An operation panel 57, a paper feeding motor drive circuit 59, a paper transferring motor drive circuit 60, a sheet transferring motor drive circuit 61, and a clutch drive circuit 64 are connected to the CPU 52. The print command, purge process command, and the like are input into the operation panel 57 by a user. Data input into the operation panel 57 is transmitted to the CPU 52.

The paper feeding motor drive circuit 59, the paper transferring motor drive circuit 60, and the sheet transferring motor drive circuit 61 drive the various motors 58, 27, 15 based upon signals output from the CPU 52. The paper feeding motor drive circuit 59 drives the paper feeding motor 58 that supplies power to the paper feeding mechanism (not shown in the figures). The paper transferring motor drive circuit 60 drives the paper transferring motor 27 that supplies power for transferring the paper and power for moving the paper transferring device 3. The sheet transferring motor drive circuit 61 drives the sheet transferring motor 15 that supplies the power for transferring the ink catching sheet 4 and the wiper 31. The clutch drive circuit 64 will drive the clutch 63 based upon signals output from the CPU 52.

The gate array 55 will generate various signals based upon the print timing signals output from the CPU 52 and the image data stored in the image memory 65. More specifically, the gate array 55 will generate print data for performing printing in accordance with the image data, a transfer clock that synchronizes with the print data, latch signals, parameter signals for producing basic print waveform signals, discharging timing signals that are output at fixed periods, and the like. These generated signals are transmitted to the sub-control board 51.

In addition, the gate array 55 lets the image memory 65 store the image data transmitted from the external device such as a computer via the interface (I/F) 66. Furthermore, the gate array 55 will generate data interrupt signals based upon data transferred from the external device via the interface 66. These signals are transmitted to the CPU 52.

The sub-control board 51 has a drive circuit that drives the ink jet head 2 based upon various signals transmitted from the main control board 50. This drive circuit applies drive pulses to various drive elements of the ink jet head 2. One drive element is arranged to correspond to one ink opening 2*e*. In addition, one drive element is arranged to correspond to one liquid opening 2*f*.

Figure 7:
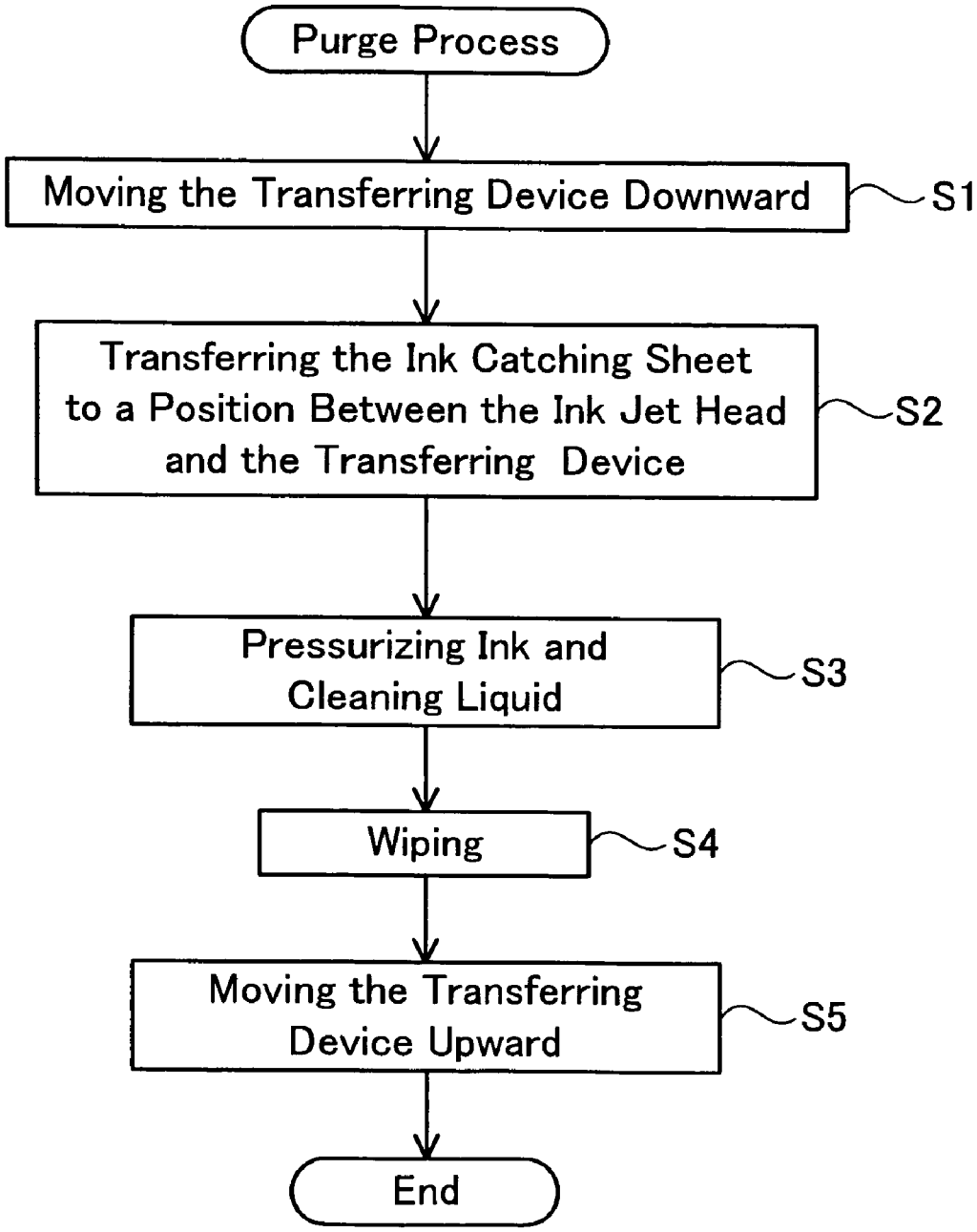
FIG. 7 shows a flowchart of a purge process that is performed by the ink jet printer.
Figure 8:
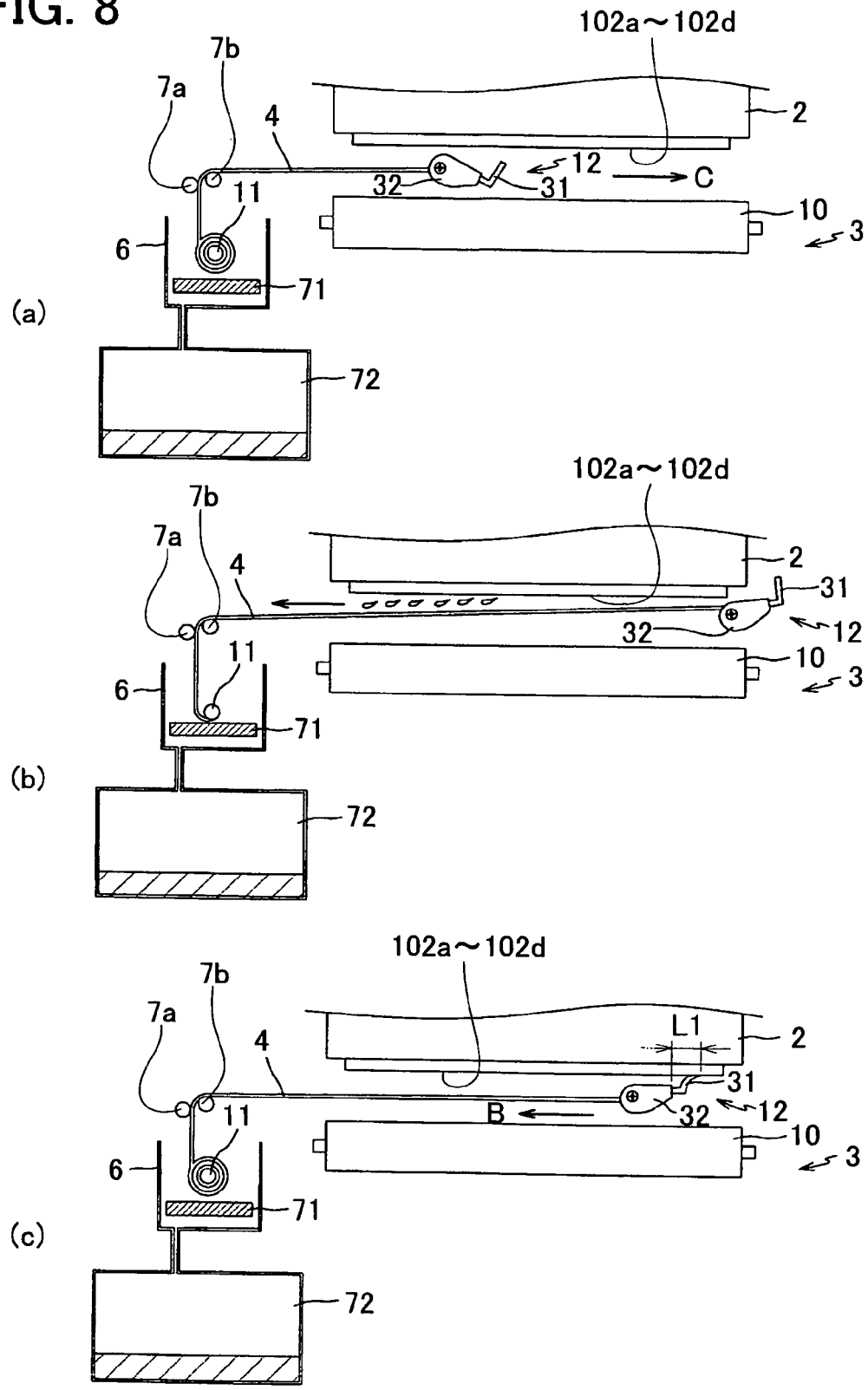
FIGS. 8 (*a*) to (*c*) are lateral views of the ink jet printer when viewed from the direction of the arrow G in FIG. 1.

Next, the purge process of a printer 1 having the aforementioned construction will be described with reference to FIGS. 7 and 8. FIG. 7 shows a flowchart of the purge process. FIGS. 8(*a*) to (*c*) chronologically show the ink catching sheet 4 and the wiper 31 moving at the stage in which the purge process is performed. In the case where a print operation has not been performed in more than a predetermined period of time, the purge process will be performed before the next print operation is performed. In addition, the purge process will also be performed in the case where a user orders the purge process by operating the operation panel 57 (see FIG. 6). The purge process will be performed by the CPU 52 (see FIG. 6).

The CPU 52 will cause the paper transferring device 3 to move downward (S1). The CPU 52 will control the clutch 63 so that the power of the paper transferring motor 27 (see FIG. 6) is supplied to the moving mechanism 20 (see FIG. 2). Next, the CPU 52 will cause the paper transferring motor 27 to be driven. Then the paper transferring device 3 moves in a direction away from the ink jet head 2. In this way, the paper transferring device 3 will move to the broken line state of FIG. 2. By causing the paper transferring device 3 to move downward in S1, a wide space will be ensured between the ink jet head 2 and the transferring belt 10. Because of this, the ink catching sheet 4 can be easily transferred to a position between the ink jet head 2 and the transferring belt 10.

Next, the CPU 52 will transfer the ink catching sheet 4 to a position between the ink jet head 2 and the transferring belt 10 (S2). The CPU 52 will drive the sheet transferring motor 15 (see FIG. 6). In this way, the moving member 12 (see FIG. 4 etc.) will move in the direction of arrow C. The movement of the moving member 12 in the direction of arrow C is shown in FIG. 8. While moving in the direction of the arrow C, the wiper operation plate 35 of the moving member 12 will be maintained in the broken line state of FIG. 4. In other words, the wiper 31 will move in the direction of arrow C with the wiper 31 not in contact with the ink discharging planes 102*a* to 102*d*. In this way, ink adhered to the wiper 31 in the previous purge process will be prevented from adhering to the ink discharging planes 102*a* to 102*d*.

When the moving member 12 moves to the position shown in FIG. 8(*b*), the first striking portion (not shown in the figures) arranged on the printer main body will strike the first projection 36 (see FIG. 4) of the wiper operation plate 35. In this way, the first projection 36 of the wiper operation plate 35 will get into the underneath of the wiper holder 32. The wiper 31 will be lifted upward. FIG. 8(*b*) shows the wiper 31 in the state in which it is lifted up. In this state, the wiper 31 will be positioned more to the right than the ink discharging planes 102*a* to 102*d*. The wiper 31 will not be in contact with the ink discharging planes 102*a* to 102*d*.

As shown in FIG. 8(*b*), the ink catching sheet 4 that is pulled to the outermost position is configured so that it will become higher toward the right. The ink catching sheet 4 that is pulled to the outermost position covers the entirety of the ink discharging planes 102*a* to 102*d*.

Next, the CPU 52 will pressurize the ink and the cleaning liquid inside the ink jet head 2 (S3). A purge pump not shown in the figures can be used in this pressurization process. By pressurizing the ink inside the ink jet head 2, the ink will be discharged from each ink opening 2*e* (see FIG. 3). In addition, by pressurizing the cleaning liquid inside the ink jet head 2, the cleaning liquid will be discharged from each liquid opening 2*f* (see FIG. 3).

The ink catching sheet 4 covers the entirety of the ink discharging planes 102*a* to 102*d*. In addition, both the edges 4*a*, 4*b* (see FIG. 1) of the ink catching sheet 4 are curved upward. Because of this, the ink catching sheet 4 can reliably catch the discharged ink and cleaning liquid. The soiling of the paper transferring device 3 and the like located below the ink catching sheet 4 can be prevented.

The ink catching sheet 4 is tilted. Because of this, the ink and cleaning liquid caught by the ink catching sheet 4 will naturally flow toward the storage box 6. The ink and cleaning liquid will flow inside the storage box 6. An ink absorbing member 71 (see FIG. 8) is provided in the interior of the storage box 6. Ink that has flowed inside the storage box 6 will be absorbed by the ink absorbing member 71. In addition, ink in excess of the absorbing capacity of the ink absorbing member 71 will be stored in a waste liquid tank 72 that communicates with the storage box 6.

The CPU 52 will stop the pressurization of the ink and cleaning liquid inside the ink jet head 2 when a predetermined amount of ink and cleaning liquid is discharged from each ink opening 2*e* and each liquid opening 2*f*.

Next, the CPU 52 will drive the sheet transferring motor 15 in the opposite direction (S4). In this way, the wiper 31 will wipe the ink discharging planes 102*a* to 102*d*. The moving member 12 will move in the direction of arrow B. This is shown in FIG. 8(*c*). The ink catching sheet 4 is rolled onto the roll shaft 11 while being stored in the storage box 6. When this occurs, the roller 7*a* will remove the ink adhered to the surface of the ink catching sheet 4. The roller 7*a* is positioned approximately directly above the storage box 6. Because of this, ink removed by the roller 7*a* will fall down into the storage box 6.

In the state shown in FIG. 8(*b*), the wiper 31 will be positioned higher than the ink discharging planes 102*a* to 102*d*. Because of this, when the moving member 12 moves in the direction of the arrow B, the wiper 31 will be in contact with the ink discharging planes 102*a* to 102*d*. The symbol X in FIG. 3 shows the position of the wiper 31 at this time. In other words, the symbol X is the beginning wiping position of the wiper 31. The wiper 31 is bending when in contact with the ink discharging planes 102*a* to 102*d*.

The moving member 12 will move in the direction of arrow B at a fixed speed. Thus, the wiper 31 will move in the direction of arrow B at the fixed speed in the state that the wiper 31 is in contact with the ink discharging planes 102*a* to 102*d*. The cleaning liquid was discharged in S3. Therefore the cleaning liquid discharged in S3 has adhered to an area where the liquid openings 2*f* (see FIG. 3) are formed. When the wiper 31 passes over the area where the liquid openings 2*f* are formed, the cleaning liquid will adhere to the surface of the wiper 31. In this way, ink adhered to the wiper 31 in the prior purge process will make contact with the cleaning liquid. The ink adhered to the wiper 31 will be diluted. When the purge process is performed, high viscosity ink is sometimes adhered to the wiper 31. The high viscosity ink will be diluted by means of the cleaning liquid.

As shown in FIG. 3, a distance L1 is maintained between the liquid openings 2*f* located at the most downstream position of the wiping direction and the ink opening 2*e*' located at the most upstream position of the wiping direction. High viscosity ink adhered to the wiper is diluted while the wiper 31 moves the distance L1. The wiper 31 will be in contact with the ink discharging planes 102*a* to 102*d* while moving in the distance L1. By rubbing the wiper 31 against the ink discharging planes 102*a* to 102*d*, ink that has been slightly diluted by the cleaning liquid will be removed from the wiper 31. If the cleaning liquid is not adhered to the wiper 31, high viscosity ink will remain on the wiper 31. In this situation, high viscosity ink on the wiper 31 will not be diluted and not be removed even if the wiper 31 moves only the distance L1. In the present embodiment, the removal of high viscosity ink adhered to the wiper 31 prior to the arrival of the wiper 31 at the ink openings 2*e* is achieved by both of adhering cleaning liquid to the wiper 31 and providing the distance L1. Research by the inventor has made it clear that ink on the wiper 31 can be effectively removed if the distance L1 is 0.5 inch or greater. Because the distance L1 in the present embodiment is 1 inch, ink on the wiper 31 can be effectively removed. However the distance L1 may be any distance which is longer than a distance between two adjacent ink openings 2*e*.

By moving the wiper 31 in the direction of the arrow B, an area in which the ink openings 2*e* are formed will be wiped by the wiper 31. Because there will be almost no ink adhered to the wiper 31, the phenomenon in which the ink openings 2*e* are closed by the ink on the wiper 31 will be effectively controlled.

When the ink discharging planes 102*a* to 102*d* are to be cleaned by the wiper 31, the second striking portion (not shown in the figures) located on the printer main body will push the first striking portion 36 of the wiper control plate 35 in the direction of the arrow I (see FIG. 4). In this way, the second projection 37 of the wiper operation plate 35 will be slip out from the wiper holder 32. The position Y shown in FIG. 3 is the position in which the first projection 36 of the wiper operation plate 35 will be pushed in the direction of arrow I. In other words, the position Y is the finishing wiping position. In this way, the wiper 31 will be in the state shown in FIG. 5(*b*). The wiper 31 will be separated from the ink discharging planes 102*a* to 102*d*.

Finally, the CPU 52 will cause the paper transferring device 3 to move upward by means of the moving mechanism 20. The CPU 52 will cause the paper transferring device 3 to move upward by driving the paper transferring motor 27. In this way, the paper transferring device 3 in the broken line position of FIG. 2 will pivot to the solid line position. In this state, the printer 1 can perform a normal print operation. When the process of S5 is complete, the purge process will be complete.

According to the printer 1 of the first embodiment described above, the cleaning liquid can be adhered to the surface of the wiper 31 during a series of the wiping operation by the wiper 31. The wiping operation of the wiper 31 can be smoothly performed in a short period of time. When the cleaning liquid supply device is formed separately from the ink jet head 2, the size of the printer will increase. According to the technology of the present embodiment, an increase in the size of the printer can be controlled.

In addition, according to the printer 1 of the present embodiment, the phenomenon in which the ink openings 2*e* become closed by ink adhered to the wiper 31 can be effectively prevented. According to this printer 1, ideal printing results can be obtained.

Modified examples of the first embodiment will be illustrated.

(1) In the aforementioned embodiment, the wiper 31 and the ink catching sheet 4 are preferably configured so that the ink that is wiped off by the wiper 31 is guided to the ink catching sheet 4.

Figure 9:
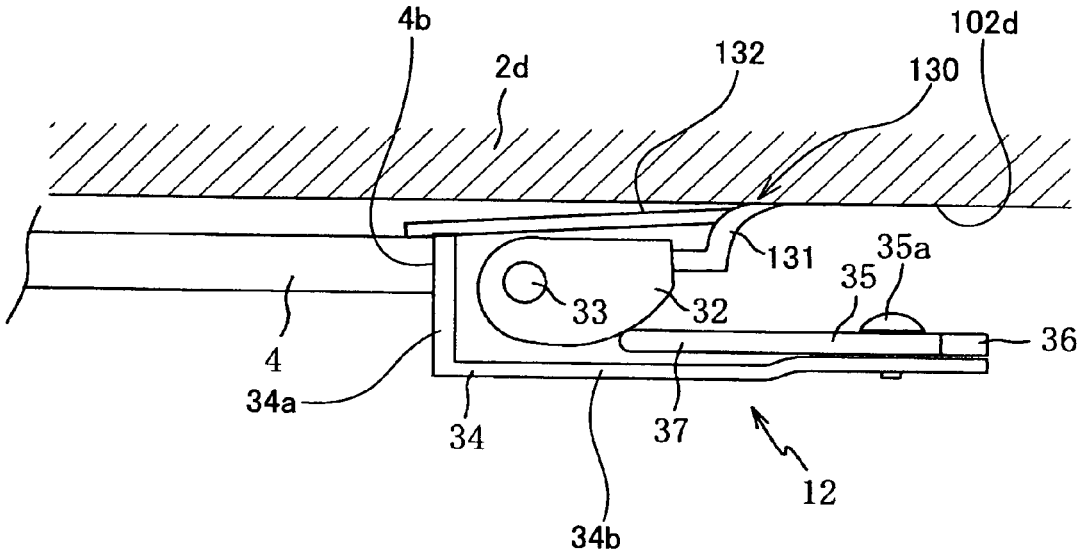
FIG. 9 shows a modified example of the wiper of the first embodiment.

FIG. 9 simply shows the construction of a modified example of a wiper 130. A member 132 that extends from a wiper body 131 to the ink catching sheet 4 is provided on the wiper 130. Ink that was wiped off by the wiper body 131 will be guided to the sheet 4 by the member 132. When this is done, the support member 34 and the like will not be soiled by the ink that was wiped off by the wiper 130.

(2) In the embodiment, the wiping speed of the wiper 31 is fixed when the wiper 31 wipes the ink discharging planes 102*a* to 102*d*. However, the wiping speed of the wiper 31 may be modified. For example, the wiping speed from the position X to the position Z1 shown in FIG. 3, and the wiping speed from the position Z1 to the position Y, may be modified.

In this situation, the wiping speed of the former is preferably made slower than the wiping speed of the latter. When this done, the amount of time from the point at which cleaning liquid is adhered to the surface of the wiper 31 until the wiper 31 arrives at the ink opening 2*e*' can be extended. The ink on the wiper 31 can be effectively diluted before the wiper 31 wipes an area where the ink openings 2*e* are formed. The ink adhered to the wiper 31 will be effectively removed.

(3) After the wiper is moved from position X to a position Z2 in FIG. 3, the wiper 31 may be temporarily stopped at the position Z2. The position Z2 is a position between the liquid openings 2*f* and the ink opening 2*e*'. The wiper is preferably stopped for several seconds. When this is done, the ink on the wiper 31 can be effectively diluted before the wiper 31 wipes an area where the ink openings 2*e* are formed.

(4) When the wiper 31 has arrived at a position Z3 of FIG. 3, the movement of the wiper 31 may be stopped. The position Z3 is a position where the wiper 31 faces the liquid openings 2*f*. Cleaning liquid may be supplied to the wiper 31 while the wiper 31 is stopped at the position Z3. When this is done, ink adhered to the wiper 31 can be well diluted by the cleaning liquid.

(5) In the aforementioned first embodiment, the beginning position of the wiping operation is the position shown by X in FIG. 3. In other words, the right edge of the ink discharging plane 102*a* is the beginning position of the wiping operation. However, the beginning position of the wiping operation may be at the position of arrow Z3 of FIG. 3. In other words, the wiper may begin wiping from the position Z3 that faces the liquid openings 2*f*. Cleaning liquid may be supplied to the wiper 31 while the wiper 31 is at the position Z3.

(6) In addition, in the aforementioned first embodiment, after a purge pump was used to perform the purge process, the wiping operation was performed by the wiper 31. This can be modified as follows. In other words, the actuator units may be driven to discharge ink from the ink openings (a flushing process), and then a wiping operation may be performed.

In this situation, the wiper 31 will preferably stop at the position Z3 of FIG. 3. Cleaning liquid is preferably supplied to the wiper 31 in this state. Next, the wiper will be moved in the direction of arrow B. At this point, it is preferable that ink is sequentially discharged from each of ink openings 2*e* immediately before the ink is wiped off with the wiper 31. In other words, it is preferable that the timing at which ink is discharged from each of the ink openings 2*e* is modified. When this is done, the flushing process can be performed with a small amount of ink. Moreover, because ink is discharged from the ink openings 2*e* immediately before being wiped off by the wiper 31, the ink can be wiped off with the wiper 31 before the ink adhered to the ink discharging planes 102*a* to 102*d* dries.

Like when a purge process is performed, the paper transferring device 3 (see FIG. 2) will move downward and the ink catching sheet 4 will be pulled out when the flushing process is performed.

(7) After being wiped by the wiper 31 from the position X to the position Y of FIG. 3, the wiper 31 may be returned from the position Y to the position X in order to wipe the ink discharging planes 102*a* to 102*d* again.

Second Embodiment

Next, a second embodiment will be described. In the first embodiment, cleaning liquid will be discharged from the liquid openings 2*f* (see FIG. 3). In the present embodiment, ink will be discharged from the liquid openings 2*f*. Cyan ink will be discharged from the liquid openings 2*f* formed in the ink jet head 2*a*. Magenta ink will be discharged from the liquid openings 2*f* of the ink jet head 2*b*. Yellow ink will be discharged from the liquid openings 2*f* of the ink jet head 2*c*. Black ink will be discharged from the liquid openings 2*f* of the ink jet head 2*d*.

Figure 10:
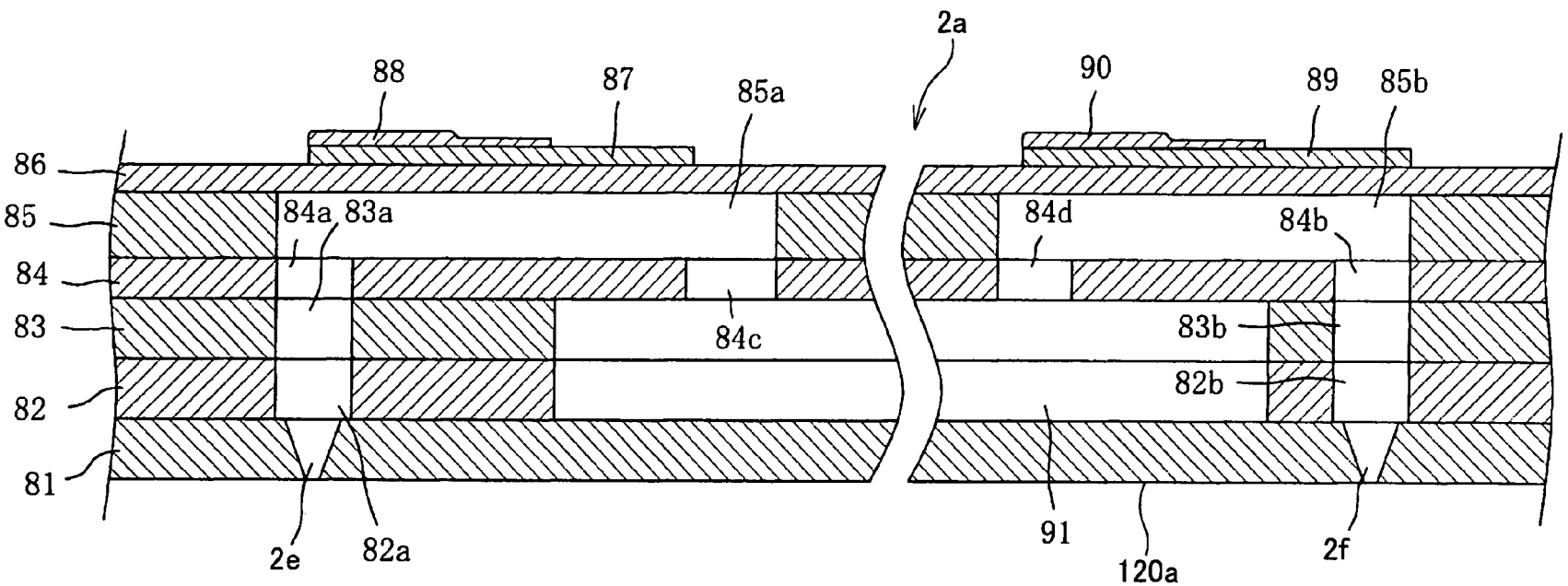
FIG. 10 shows a cross-sectional view of an ink jet head of a second embodiment.

FIG. 10 shows a cross-sectional view of the ink jet head 2*a* of the present embodiment. The ink jet head 2*a* is formed by stacking a nozzle plate 81, two manifold plates 82, 83, a spacer plate 84, a base plate 85, and a piezoelectric sheet 86. The six sheets 81 to 86 are adhered together by means of an adhesive.

An ink opening 2*e* and a liquid opening 2*f* are formed on the nozzle plate 81. Although not shown in FIG. 10, a plurality of ink openings 2*e* and a plurality of liquid openings 2*f* are formed in the nozzle plate 81. A hole 82*a* and a hole 82*b* are formed in the manifold plate 82. The hole 82*a* is formed in a position that corresponds to the ink opening 2*e*. The hole 82*b* is formed in a position that corresponds to the liquid opening 2*f*. A hole 83*a* and a hole 83*b* are formed in the manifold plate 83. The hole 83*a* is formed in a position corresponding to the hole 82*a*. The hole 83*b* is formed in a position corresponding to the hole 82*b*. In addition, an ink chamber 91 is formed by the two manifold plates 82, 83.

Holes 84*a*, 84*b*, 84*c*, 84*d* are formed in the spacer plate 84. The hole 84*a* is formed in a position corresponding to the hole 83*a*. The hole 84*b* is formed in a position corresponding to the hole 83*b*. The hole 84*c* and the hole 84*d* are formed in positions that correspond to the ink chamber 91. A pressure chamber 85*a* that corresponds to the ink opening 2*e*, and a pressure chamber 85*b* that corresponds to the liquid opening 2*f*, are formed in the base plate 85. One pressure chamber 85*a* is formed to correspond to one ink opening 2*e*. Thus, a plurality of pressure chambers 85*a* is formed in the base plate 85. In addition, one pressure chamber 85*b* is formed to correspond to one liquid opening 2*f*. Thus, a plurality of pressure chambers 85*b* is formed in the base plate 85. In addition, ink supply holes (not shown in the figures) that supply ink from the ink cartridges to the ink chambers 91 are provided in the spacer plate 84 and the base plate 85.

A drive electrode 87 is formed on the upper surface of the piezoelectric sheet 86 in a position that corresponds to the pressure chamber 85*a*. In addition, a drive electrode 89 is formed on the upper surface of the piezoelectric sheet 86 in a position that corresponds to the pressure chamber 85*b*. Contact area 88, 89 are provided on the respective drive electrodes 87, 89. The contact areas 88, 89 are connected to a flexible circuit plate (not shown in the figures). The drive electrodes 87, 89 are connected to a drive circuit via the flexible circuit plate (not shown in the figures). When a voltage is applied to the drive electrode 87, a portion of the piezoelectric sheet 86 corresponding to the drive electrode 87 will bend upward. In this way, the pressure inside the pressure chamber 85*a* will decrease. The ink inside the ink chamber 91 will flow into the pressure chamber 85*a* via the hole 84*c*. When the voltage of the drive electrode 87 is eliminated, the portion of the piezoelectric sheet 86 corresponding to the drive electrode 87 will return to its original state. In this way, the ink inside the pressure chamber 85*a* will be pressurized. Then the ink inside the pressure chamber 85*a* will be discharged to the exterior via the holes 84*a*, 83*a*, 82*a* and the ink opening 2*e*.

Likewise, when a voltage is applied to the drive electrode 89, the ink inside the ink chamber 91 will flow into the pressure chamber 85*b* via the hole 84*d*. In addition, when the voltage of the drive electrode 89 is eliminated, the ink inside the pressure chamber 85*b* will be discharged to the exterior via the holes 84*b*, 83*b*, 82*b* and the liquid opening 2*f*.

According to the present embodiment, the ink discharged from the ink opening 2*e* and the ink discharged from the liquid opening 2*f* is the same ink. The ink chamber 91 for the ink discharged from the ink opening 2*e* can be used for the ink discharged from the liquid opening 2*f*. The ink chamber 91 can be shared. The construction of the ink jet heads 2*a* to 2*d* can be simplified. In addition, by adopting the ink as a cleaning fluid, a cartridge for cleaning liquid can be unnecessary.

The technology of the disclosure of the present specification can include various modifications. For example, although the line type ink jet printer was described in each of the aforementioned embodiments, the technology of the disclosure of the present specification can also be applied to serial type ink jet printers. In addition, the wiping operation may be performed by moving the ink jet head 2 rather than moving the wiper 31. Furthermore, the wiping operation may be performed by moving both the wiper 31 and the ink jet head 2.

The invention claimed is:

1. An ink jet printer, comprising:

a print medium transfering device that transfers a print medium;

an ink jet head having an ink discharging plane, wherein a plurality of ink openings for discharging ink toward the print medium being transferred by the print medium transferring device and a liquid opening for discharging liquid are formed on the ink discharging plane, the ink openings are closer to one end of the ink discharging plane than the liquid opening is, the liquid opening is closer to the other end of the ink discharging plane than the ink openings are, the ink openings are formed at positions where the ink openings face the print medium being transferred by the print medium transferring device, the liquid opening is formed at a position where the liquid opening does not face the print medium being transferred by print medium transferring device, and the ink jet head is located at a predetermined position and does not move from the predetermined position when the ink openings discharge the ink toward the print medium;

a wiper that wipes the ink discharging plane of the ink jet head; and a wiper transferring device that transfers the wiper such that the wiper wipes the ink discharging plane from a beginning position located at the other end side of the ink discharging plane to a finishing position located at the one end side of the ink discharging plane, wherein the ink jet head is located at the predetermined position and does not move from the predetermined position when the wiper transferring device transfers the wiper such that the wiper wipes the ink discharging plane from the beginning position to the finishing position, wherein the liquid discharged from the liquid opening adheres to the wiper when the wiper wipes an area where the liquid opening is formed, and a distance between the liquid opening and an ink opening, among the plurality of ink openings on the discharging plate, located at the most upstream position of the wiping direction of the wiper is longer than a distance between the two adjacent ink openings.

2. The inkjet printer as in claim 1, wherein the liquid is discharged from the liquid opening before the wiper faces the liquid opening, and the liquid is not discharged from the liquid opening when the wiper faces the liquid opening.

3. The ink jet printer as in claim 1, wherein the beginning position is a position where the wiper faces the liquid opening.

4. The ink jet printer as in claim 1, wherein the beginning position is a position between the other end of the ink discharging plane and the liquid opening.

5. The ink jet printer as in claim 1, wherein the wiper transferring device transfers the wiper such that (1) the wiper wipes the ink discharging plane from the beginning position to a facing position where the wiper faces the liquid opening, 2the wiper temporarily stops wiping at the facing position for a first period, and (3) the wiper wipes the ink discharging plane from the facing position to the finishing position after the first period has elapsed, and the liquid is discharged from the liquid opening while the wiper temporarily stops wiping at the facing position.

6. The ink jet printer as in claim 1, wherein the wiper transferring device transfers the wiper such that (1) the wiper wipes the ink discharging plane from the beginning position to a middle position between the liquid opening and the ink opening located at the most upstream position of the wiping direction, (2) the wiper temporarily stops wiping at the middle position for a second period, and (3) the wiper wipes the ink discharging plane from the middle position to the finishing position after the second period has elapsed.

7. The ink jet printer as in claim 1, wherein the wiper transferring device transfers the wiper such that a wiping speed of the wiper at an area between the liquid opening and the ink opening located at the most upstream position of the wiping direction is slower than a wiping speed of the wiper at an area between the ink opening located at the most upstream position of the wiping direction and an ink opening located at the most downstream position of the wiping direction.

8. The ink jet printer as in claim 1, wherein the liquid discharged from the liquid opening is same as the ink discharged form the ink openings.

9. The ink jet printer as in claim 8, wherein the ink jet head has an ink chamber that communicates with both the ink openings and the liquid opening.

10. The ink jet printer as in claim 1, wherein the ink jet head performs a recovery action to recover an ink discharging ability by discharging the ink from the ink openings, and the wiper wipes the ink discharging plane of the ink jet head after the recovery action.

11. The ink jet printer as in claim 10, further comprising:

an ink catching sheet that catches the ink discharged from the ink openings during the recovery action.

12. The ink jet printer as in claim 11, wherein the ink catching sheet is connected with the wiper, and the wiper transferring device transfers the ink catching sheet and the wiper.

13. The ink jet printer as in claim 1, wherein the ink openings are arranged along a direction that the wiper is transferred by the wiper transferring device.

14. The ink jet printer as in claim 1, wherein the ink discharged from the ink openings is utilized for printing on the print medium, and the liquid discharged from the liquid opening is not utilized for printing on the print medium.

15. The inkjet printer as in claim 14, wherein the liquid opening discharges cleaning liquid.

* * * * *